US005435262A

United States Patent [19]

Grinius et al.

[11] Patent Number: 5,435,262

[45] Date of Patent: Jul. 25, 1995

[54] SEMI-SUBMERSIBLE OFFSHORE PLATFORM WITH ARTICULATED BUOYANCY

[75] Inventors: Victor G. Grinius, San Diego; Arthur C. Lynch, San Marcos, both of Calif.

[73] Assignee: Offshore Model Basin, Escondido, Calif.

[21] Appl. No.: 275,133

[22] Filed: Jul. 14, 1994

[51] Int. Cl.[6] ..... B63B 35/44

[52] U.S. Cl. ..... 114/264; 114/74 T

[58] Field of Search ..... 114/121, 122, 123, 125, 114/264, 265, 74 T; 405/159

[56] References Cited

U.S. PATENT DOCUMENTS

| | | | |
|---|---|---|---|
| Re. 29,478 | 11/1977 | Goren et al. | 114/265 |
| 1,813,986 | 7/1931 | Breeze . | |
| 2,678,017 | 5/1954 | Collins . | |
| 3,160,135 | 12/1964 | De Vries | 114/125 |
| 3,163,147 | 12/1964 | Collipp . | |
| 3,327,666 | 6/1967 | Hedges . | |
| 3,550,549 | 12/1970 | Horton | 441/3 |
| 3,815,846 | 6/1974 | Biewer | 242/158 |
| 3,837,309 | 9/1974 | Biewer . | |
| 3,866,555 | 2/1975 | Korkut . | |
| 3,868,760 | 3/1975 | Korkut | 29/470 |
| 3,880,102 | 4/1975 | Biewer . | |
| 4,015,552 | 4/1977 | Korkut | 114/265 |
| 4,062,192 | 12/1977 | Biewer . | |
| 4,065,101 | 12/1977 | Korkut | 254/184 |
| 4,167,148 | 9/1979 | Fayren | 114/265 |
| 4,342,526 | 8/1982 | Mousselli | 405/159 |
| 4,479,401 | 10/1984 | Korkut | 74/527 |
| 4,556,008 | 12/1985 | Copson | 114/265 |
| 5,038,702 | 8/1991 | Bowes | 114/265 |
| 5,135,327 | 8/1992 | White et al. | 405/224 |

FOREIGN PATENT DOCUMENTS 2141076 12/1984 United Kingdom .

*Primary Examiner*—Jesû D. Sotelo

*Attorney, Agent, or Firm*—Brown, Martin Haller & McClain

[57] ABSTRACT

A semi-submersible offshore platform comprising a hull having at least one oil storage tank and a fixed centralized support member. The hull has a peripheral edge. The platform further comprises a deck coupled to the support member and a plurality of stabilizer buoys. Each of the buoys is coupled to the hull and is positioned adjacent the peripheral edge of the hull, whereby the buoys pitch, roll, heave, sway, and surge relative to the hull. Also provided is a system for stabilizing a semi-submersible offshore platform having a submersible hull. The system comprises a buoyant stabilizer and a constant tension device attached to the platform and coupled to the buoyant stabilizer, relative to the submersible hull.

42 Claims, 11 Drawing Sheets

RESULTS OF SEAKEEPING IN REGULAR WAVES

| TEST NO. | WAVE PERIOD T(SEC) | WAVE HEIGHT (FT) | HEAVE (p-p FT) | PITCH (AMP DEGREE) | HEAVE RAO (p-p H FT p-p $W_H$ FT) | PITCH RAO (PITCH AMP DEG/MAX WAVE SLOPE*) | MAX BOW LINE TENSION (KIPS) | MAX STERN LINE TENSION (KIPS) |
|---|---|---|---|---|---|---|---|---|
| 103 | 7.746 | 26.5 | 0 | 0.23 | 0 | 0.0148 | 166 | 95 |
| 104 | 8.6 | 23.5 | 0 | 0.50 | 0 | 0.0447 | 123 | 71 |
| 105 | 9.295 | 21.5 | 0.6 | 0.78 | 0.0279 | 0.08915 | 212 | 56 |
| 106 | 10.07 | 25.5 | 1.65 | 1.22 | 0.0647 | 0.1380 | 238 | 37 |
| 107 | 9.295 | 23.5 | 1.15 | 0.82 | 0.0489 | 0.0857 | 231 | 45 |
| 108 | 11.62 | 24.0 | 3.9 | 1.51 | 0.1625 | 0.2416 | 229 | 43 |
| 109 | 12.78 | 25.0 | 5.73 | 1.72 | 0.2294 | 0.3196 | 220 | 41 |
| 110 | 13.94 | 27.0 | 7.3 | 1.75 | 0.2704 | 0.3584 | 212 | 32 |
| 111 | 15.49 | 26.0 | 9.0 | 1.60 | 0.346 | 0.4201 | 199 | 47 |
| 112 | 17.04 | 25.85 | 10.0 | 1.41 | 0.3775 | 0.4505 | 179 | 47 |
| 113 | 18.59 | 27.0 | 10.43 | 1.23 | 0.3870 | 0.4477 | 171 | 63 |
| 114 | 20.14 | 23.0 | 10.25 | 0.99 | 0.4457 | 0.4965 | 166 | 37 |
| 115 | 21.69 | 23.0 | 10.6 | 0.95 | 0.4609 | 0.5526 | 171 | 63 |
| 116 | 23.24 | 27.0 | 12.55 | 1.15 | 0.4648 | 0.6542 | 177 | 54 |
| 117 | 14.72 | 26.5 | 7.95 | 1.60 | 0.3000 | 0.3721 | 212 | 32 |
| 118 | 11.23 | 24.0 | 3.3 | 1.50 | 0.1375 | 0.2242 | 235 | 17 |
| 119 | 13.555 | 26.0 | 6.6 | 1.70 | 0.2538 | 0.3417 | 222 | 13 |

NATURAL PERIODS
PITCH : 61.4 SEC
HEAVE: 108.4 SEC

MAX WAVE SLOPE = $2.93\ W_H/T^2$
WHERE SLOPE IS IN DEGREES
$W_H$ IS IN INCHES
T IS IN SECONDS

PRETENSIONS (KIPS) 129.6 105.84

FIG. 6

SEMI-SUBMERSIBLE OFFSHORE PLATFORM WITH ARTICULATED BUOYANCY

BACKGROUND OF THE INVENTION

1. Field of the Invention

The present invention relates to a semi-submersible offshore platform that has articulated buoyancy. More particularly, the present invention relates to a semi-submersible ocean platform having a submersible hull for oil storage that is attached to the platform by a fixed watertight column and having a set of articulated buoys.

2. Description of the Related Art

In an attempt to locate new oil fields, petroleum exploration expanded beyond land-based operations, with the petroleum industry seeking oil under the ocean and other bodies of water. At first, exploration, drilling, and production were generally conducted in the relatively shallow waters near land masses. In conventional shallow water drilling, a self-contained fixed platform is erected, the platform being supported by pilings driven into the sea floor. In deep water, however, such platforms cannot be used, because it is not feasible to erect a platform with pilings sufficiently long to stretch from the surface to the sea floor.

In deep water applications, therefore, the industry turned to semi-submersible, surface floating drilling vessels that are either towed or self-propelled to the drilling site. Semi-submersible drilling platforms include a submersible hull and an above-water deck that are interconnected. These semi-submersible platforms are moored over the drilling site and are normally provided with a central opening through which the drilling rig is operated.

Conventional semi-submersible drilling platforms, however, have various drawbacks. First, conventional semi-submersibles are generally rigid, with a minimum of moving parts, resulting in a lack of stability in response to substantial wave forces. In such rigid semi-submersibles, the hull and deck are rigidly attached, lacking additional stabilizers that can move with respect to the unitary hull/deck. Second, conventional semi-submersibles generally lack storage capacity in the hull; they must therefore be off-loaded to an interconnected tanker when pumping undersea oil to the surface, i.e., when in the production state.

To overcome the first drawback, i.e., lack of stability, semi-submersible platforms have been designed with buoys or stabilizers that move radially (i.e., pitch and roll) relative to the unitary hull/deck about a fixed point on the submerged hull. Examples of designs with buoys that pitch and roll appear in U.S. Pat. Nos. 3,837,309, 3,880,102, and 4,556,008. Such designs include several elongated buoys affixed to the perimeter of the hull, for example, by a universal joint. The addition of such buoys in these designs increases the stability of the platform in rough seas.

But these designs do not optimize stability, because the buoys lack the capacity to sway and surge or heave relative to the hull/deck and to each other. For purposes of this description, the terms "sway" and "surge" refer to side-to-side movement, in other words, movement along the plane of the water's surface. The term "heave" refers to up and down movement, that is, movement along a line connecting the sea floor and surface. A platform having buoys that can move radially about the platform and can also sway, surge and heave relative to the platform and to each other would substantially enhance the stability of the platform over one having buoys that merely move radially.

As to the second drawback, i.e., the lack of oil storage capacity in the hull, most semi-submersible drilling platforms lack any such storage capacity. Although some platforms have hulls with storage, no conventional platform exists incorporating buoys that can sway and surge or heave with hull storage. Furthermore, no platform exists having hull storage, a fixed centralized columnar support affixing the deck to the hull, and buoys that can sway and surge and/or heave. The fixed centralized support not only can support the deck, but also can provide access to the hull and serve as an enclosure for piping, machinery, etc. And with a fixed centralized support, the need for peripheral truss columns is eliminated, thereby reducing complexity and expense. Accordingly, no platform exists that features the advantages provided by buoys that can sway and surge and/or heave and a storage hull, much less such a storage hull having a fixed centralized columnar support member.

Therefore, a need exists for a semi-submersible deep-water platform that has a submersible hull for oil storage attached to the deck by a fixed watertight column and has a set of articulated buoys that can heave, sway and surge relative to the platform and relative to each other.

SUMMARY OF THE INVENTION

Accordingly, the present invention is directed to a semi-submersible offshore platform for deep-sea drilling, exploration, and production that substantially obviates one or more of the problems due to the limitations and disadvantages of the related art.

Additional features and advantages of the invention will be set forth in the description that follows, and in part will be apparent from the description, or may be learned by practice of the invention. The objectives and other advantages of the invention will be realized and attained by the apparatus particularly pointed out in the written description and claims of this application, as well as the appended drawings.

To achieve these and other advantages, and in accordance with the purpose of the invention as embodied and broadly described herein, the invention is a semi-submersible offshore platform. The platform comprises a hull having at least one oil storage tank and a fixed centralized support member, the hull having a peripheral edge. The platform further comprises a deck coupled to the centralized support member. Finally, the platform comprises a plurality of stabilizer buoys, each of the buoys having a coupler for coupling the buoy to the hull, the buoys being positioned adjacent the peripheral edge of the hull, whereby the buoys pitch, roll, heave, surge and sway relative to the hull, and heave, pitch and roll relative to each other.

In another aspect, the present invention is a system for stabilizing a semi-submersible offshore platform, the platform having a submersible hull. The system comprises a buoyant stabilizer and a constant tension device attached to the platform and coupled to the buoyant stabilizer, whereby the buoyant stabilizer heaves relative to the submersible hull.

It is to be understood that both the foregoing general description and the following detailed description are exemplary and explanatory only and are not restrictive of the invention, as claimed.

The accompanying drawings are included to provide a further understanding of the invention and are incorporated in and constitute a part of this specification, to illustrate the embodiments of the invention, and, together with the description, to explain the principles of the invention.

BRIEF DESCRIPTION OF THE DRAWINGS

FIG. 6 is a table providing test results from a model of the present invention, reporting responses of the model to various wave action.

DETAILED DESCRIPTION OF THE INVENTION

Reference will now be made in detail to the present preferred embodiments of the invention, examples of which are illustrated in the accompanying drawings. Wherever possible, the same reference numbers will be used throughout the drawings to refer to the same or like parts.

In accordance with the present invention, an apparatus is provided for an articulated semi-submersible ocean platform and a system is provided for stabilizing such a platform in response to various wave forces. The platform includes a deck and a hull, the hull having capacity to store a liquid, and a substantially centralized fixed column. The deck is supported by the fixed column. The platform also includes a system of articulated buoys for stabilizing the platform. The system for stabilizing the platform includes at least two buoys attached to the hull that can move radially, i.e., pitch and roll, about points on the hull to which they are attached and can heave, sway and surge relative to the platform and can at least pitch, roll, and heave relative to each other.

In space, there are six ways in which a body can move, in other words, six degrees of freedom. The first two are "pitch" and "roll," which are radial motions. In regards to offshore drilling platforms, pitch and roll refers to the ability of the buoys to move radially with respect to the submerged hull, to which the buoys are attached. Pitch is radial motion in a first plane (e.g., the X-plane) and roll is radial motion in a plane orthogonal to the first plane (e.g., the Y-plane). As defined above, the third motion, "heave," refers to up and down motion of the buoy, while fourth and fifth motions, "sway" and "surge," refer to orthogonal lateral motions parallel to the water's surface. The final motion, "yaw," refers to rotational movement of the buoy, in other words, its ability to spin on its longitudinal axis. Yaw becomes significant only when the buoy has a shape that will experience rotational reactions to wave forces. An example of such a shape would be a rectangular buoy. As embodied herein, however, the buoys have a cylindrical, conical, or spherical shape and are thus not susceptible to rotational forces, i.e., yaw. Nevertheless, if, for example, a rectangular buoy were used, it could be equipped with swivel device to permit the buoy to yaw. A body that can perform all six motions has six-degrees of freedom. The more degrees of freedom a body has, the more responsive it is to forces acting on it, and the greater its capacity to neutralize or minimize those forces. Accordingly, a buoy that has five or six degrees of freedom can substantially minimize, even neutralize, the effect wave action has on an offshore drilling platform.

Figure 1:
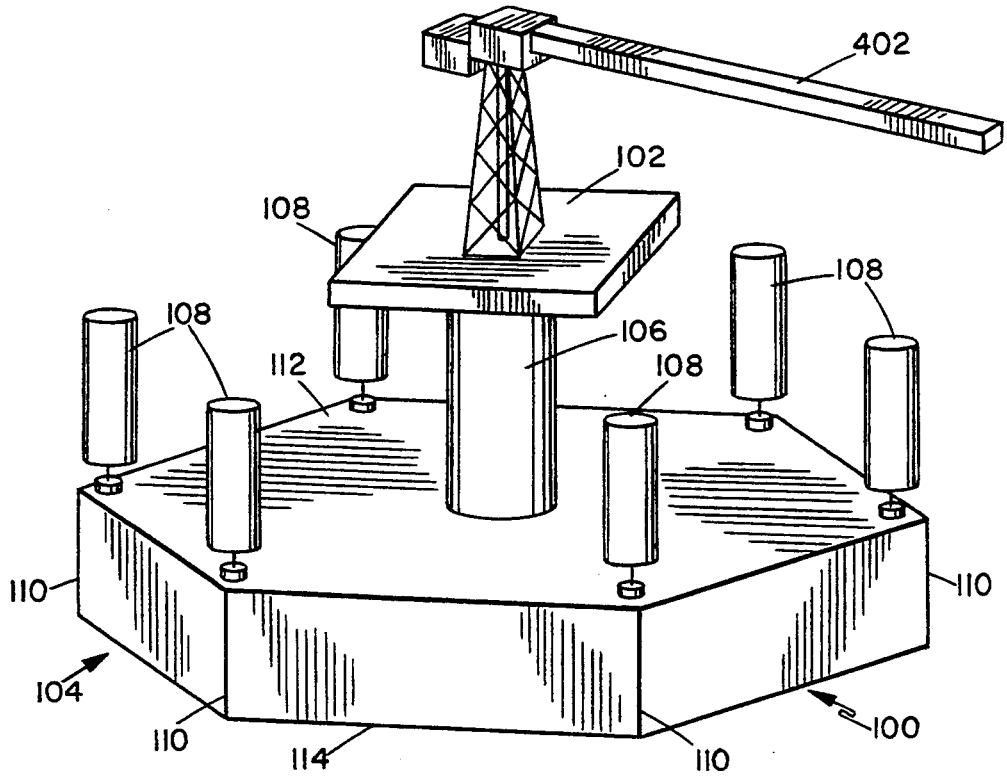
FIG. 1 is a perspective view of the semi-submersible offshore platform of the present invention.

An exemplary embodiment of the articulated semi-submersible ocean platform of the present invention is illustrated in FIG. 1 and is designated generally by reference numeral 100. The articulated semi-submersible ocean platform 100 of the present invention includes a deck 102 and a hull 104 having a centralized fixed column 106. Articulate stabilizer buoys 108 are coupled to the hull 104.

As illustrated in FIG. 1, preferably the hull 104 of the semi-submersible platform 100 is a hexagonal section. The hexagonal section has six corners 110 and a top 112 and a bottom 114. Alternatively, the hull 104 may be a square or circular section. As those skilled in the art will understand, these shapes are merely exemplary, and the hull 104 may be constructed in various geometric and polygonal shapes. In the preferred embodiment, which is illustrated in FIG. 1, the dimensions of the hull 104 are 450 feet across the corners 110 and 50 feet from bottom 112 to top 114. The hull 104 may be constructed from pre-stressed concrete, which obviates the need to build the platform in a shipyard and results in cost savings. In addition, as shown in FIG. 1, the concrete constituting the platform may be panelized.

Figure 2:
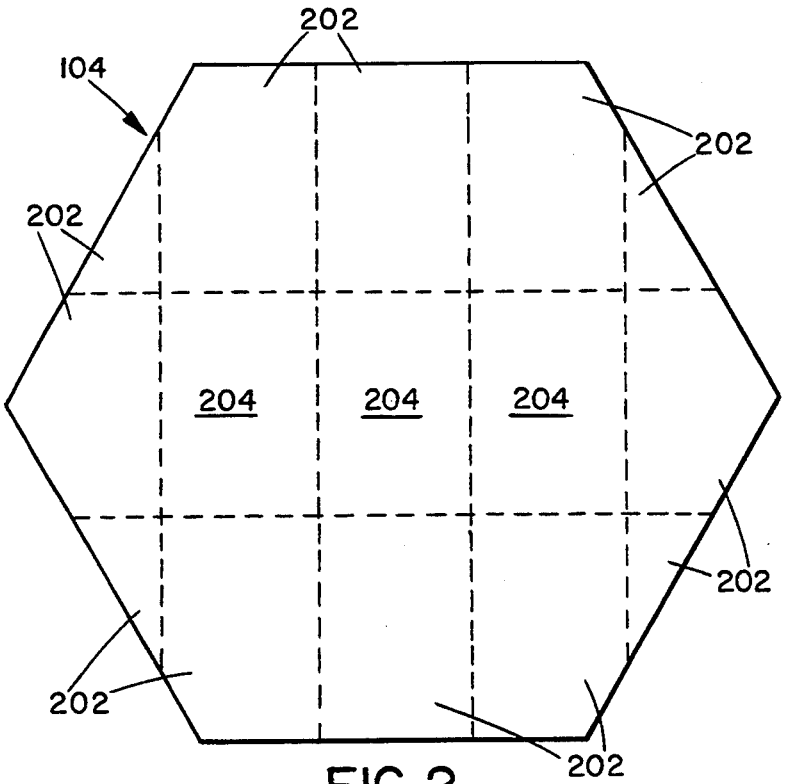
FIG. 2 is a top plan view of the hull showing the storage and hard tanks.

Referring now to FIG. 2, the hull 104 may be compartmentalized to provide for pressure compensated oil storage tanks 202 and uncompensated hard tanks 204 for both oil and variable ballast. The layout and dimensions of the tanks 202, 204 in FIG. 1 are merely exemplary, and thus other configurations may be used. With the addition of the tanks 202, 204 the platform 100 may be made floatable. This will facilitate towing or self propulsion of the platform to the drilling site. Deployment of the platform 100 will be described in detail below. The hull may also include other compartments, such as a fuel tank 206, a water tank 208, a pump room 210, a compressed-air storage compartment 212, and other desirable compartments. The pump room 210 may be used to house pumps, compressors for pumping and blowing water, air, ballast, etc., plus the necessary manifolds, control valves, and piping.

The pressure compensated storage tanks 202 provide for storage of crude oil, obviating the need for a storage tanker or pipeline into which to off-load the oil when it is pumped to the surface. When production from a site enters the platform 100 through the central column 106, gas is separated from the production, and crude is then pumped to the storage tanks 202, displacing sea water held in the tanks 202. In the embodiment illustrated in FIGS. 1 and 2, the storage tanks 202 in the hull 104 have the capacity to store 1 million barrels of oil.

Preferably, the storage tanks 202 are pressure compensated and the hard tanks 204 are uncompensated in a volumetric ratio of about 9 to 2. When a barrel of oil being pumped from the sea floor displaces a like volume of sea water held in a storage tank 202, a gain in buoyancy of approximately 60 pounds results, due to the differences in density of the oil and water. If 2/9 of a barrel of crude oil is added simultaneously to a hard tank 204, displacing air held in the hard tank 204, a loss in buoyancy of approximately 60 pounds results. Accordingly, the net change in buoyancy of the platform is zero. Overall changes in the weight of the platform 100 are handled by changing the amount of sea water in the variable ballast tanks. And when crude is pumped from the storage tanks 202 to a tanker to off-load the oil for transport to land, the overall ballast condition of the platform remains unchanged so long as the 9 to 2 pumping ratio is maintained. The control system and valves, motors, etc., for ballasting and deballasting the platform are well-known to those skilled in the art, examples of which are shown and described in U.S. Pat. Nos. 3,837,309 and 3,880,102.

The support column 106 is preferably centrally located on the hull 104. In the embodiment illustrated in FIG. 1, the column 106 is located in approximately the center of the hexagonal hull 104; it has a diameter of approximately 50 feet and a length of approximately 100 to 150 feet. If the hull 104 were another shape, such as a circle or rectangle, the column 106 would similarly be located in approximately the center of the hull 104. The column 106 supports the deck 102 and may be constructed such that it provides access to the hull 104 and serves as an enclosure for piping, machinery, haws pipes, etc. Alternatively, the fixed centralized support column 108 could be replaced by, or augmented with, two or more truss columns, such as those used on jack-up drilling rigs.

Figure 16:
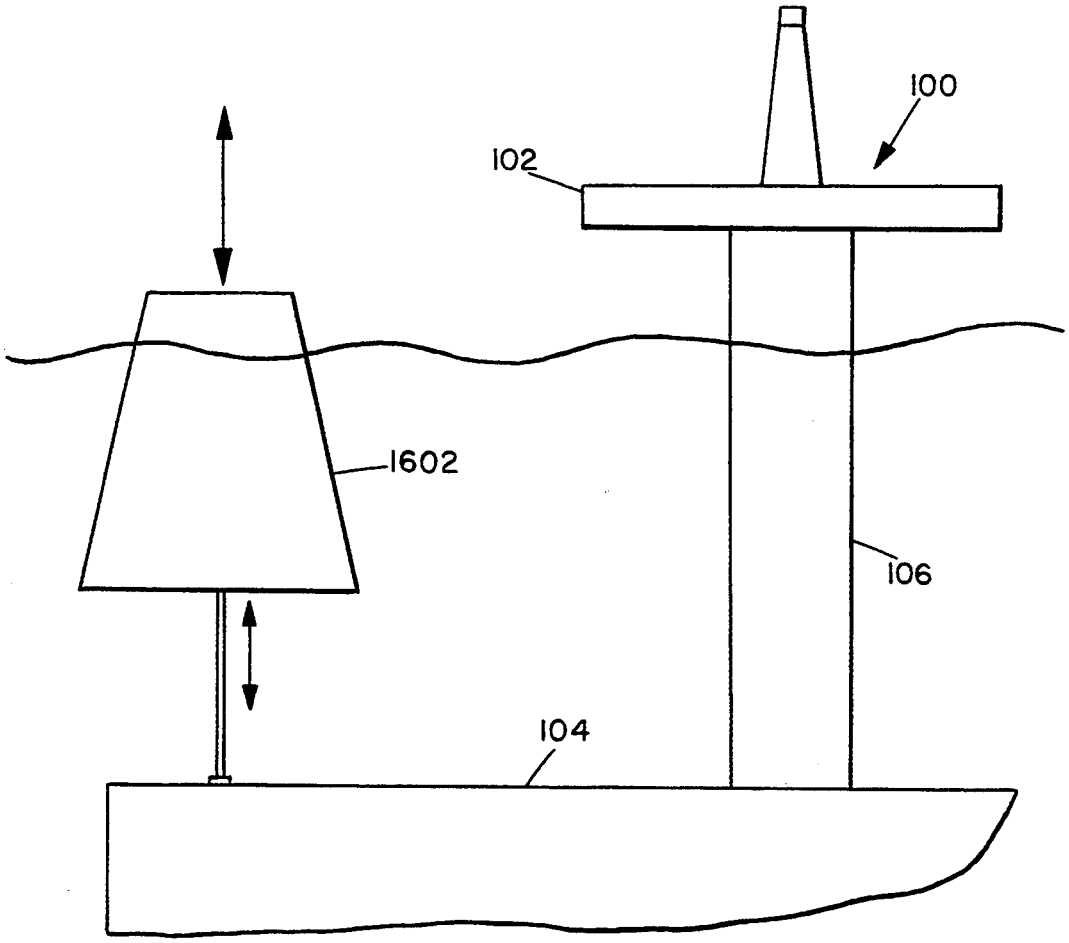
FIG. 16 is a partial side-view of the semi-submersible offshore platform of the present invention having conically shaped buoys.

The articulate stabilizer buoys 108, preferably columns, are coupled to the periphery of the hull and are used to minimize the effects of wave action on the platform 100. Although illustrated as cylindrical, the buoys 108 could be almost any shape, for example, conical or spherical. FIG. 16 illustrates the platform 100 of the present invention, in partial side-view, in which conical buoys 1602 are coupled to the hull 104 of the platform 100 With cylindrical buoys, a constant water plane is maintained on the exterior surface of the buoys 108 when they move up and down relative to the water's surface. With conical or spherical buoys, on the other hand, a variable water plane area results; that is, as the conical or spherical buoy moves up and down relative to the water's surface, the circumference or perimeter of the buoy's outside surface changes, becoming greater and smaller.

Furthermore, in the present invention, multiple articulation of the stabilizer buoys 108 is attained. First, the buoys 108 articulate relative to each other, in that each buoy 108 can pitch, roll, heave, sway, surge and yaw independently from the other buoys. Second, the buoys 108 articulate relative to the hull 104, in that all of the buoys 108 can pitch, roll, heave, sway, surge and independent of the hull 104. Multiple articulation of the buoys 108 maximizes the stability of the platform 100 in response to wave action. Nevertheless, the buoys 108 could alternatively be fixed to the hull 104, thereby precluding articulation of the buoys 108 relative to the hull 104 and to each other. The buoys 108 could be fixed to the hull 104 in a variety of ways. For example, they could be integral extensions from the hull or could be set within a retaining structure that prevents pitching, rolling, surging, and swaying motions and affixed to the hull by a static line or chain that prevents heaving and yawing motions.

As shown in FIG. 1, in the preferred embodiment, six elongated columns 108 are provided, each corresponding and being coupled to a corner 110 of the hexagonal hull 104. In the illustrated embodiment, the columns 108 are cylindrical sections, 25 feet in diameter and 90 feet long. The columns 108 are watertight and buoyant and, as with the hull, may be constructed of pre-stressed concrete.

Figure 3:
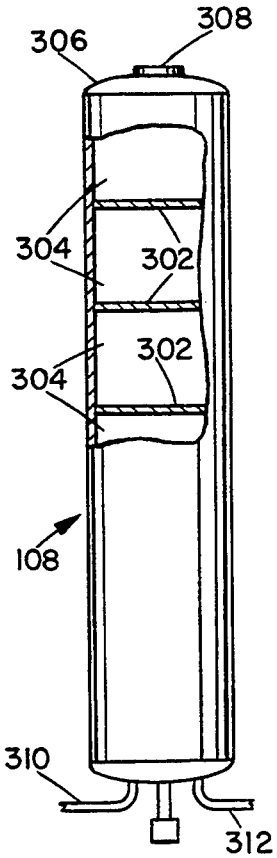
FIG. 3 is a cut-away view of a stabilizer buoy, illustrating the interior compartments.

With reference to FIG. 3, like the hull 104, the buoys 108 may have compartments 304 formed by transversely disposed partitions or bulkheads 302 that also reinforce the buoys. The compartments 304 are used to hold water that is pumped into and out of the buoys 108 for ballasting and deballasting. The top 306 of each buoy 108 may be provided with a manhole that is closed by a removable cover 308. The buoys 108 are coupled to the hull 104 such that they at least pitch, roll, and heave, but preferably pitch, roll, heave, sway, and surge, with respect to the hull. (As described above, because the buoys are cylindrical, it is not necessary for them to be able to yaw.) The buoys can also at least pitch, roll, and heave, but also may sway and surge, relative to each other. The manner in which the buoys 108 are coupled to the hull 104 will be described in detail below.

To ballast and deballast the buoys 108, a pumping system may be provided. The pumping system includes a drain conduit 310 for each buoy 108, the drain conduits 310 being used to remove water from the buoys 108 and extending through the exterior of the buoys and into each compartment 304. The flow through the drain conduits 310 is controlled for each compartment 304 by valves (not shown). The pumping system also includes an air conduit 312 for each buoy 108, the air conduits 312 being used to conduct air into and thus force water out of the compartments 304. As with the drain conduits 310, the air conduits 312 extend through the exterior of the buoys 108 and into each compartment 304, and the flow through the air conduits 312 is controlled for each compartment 304 by valves (not shown). The pumping system also includes motors to control the valves and pumps for forcing water and air through the drain and air conduits 310, 312, respectively. The pumping system can also be used to ballast and deballast the hull 104. Such pumping systems are well-known in the art, examples of such a system being described in U.S. Pat. Nos. 3,837,309 and 3,880,102.

Figure 4:
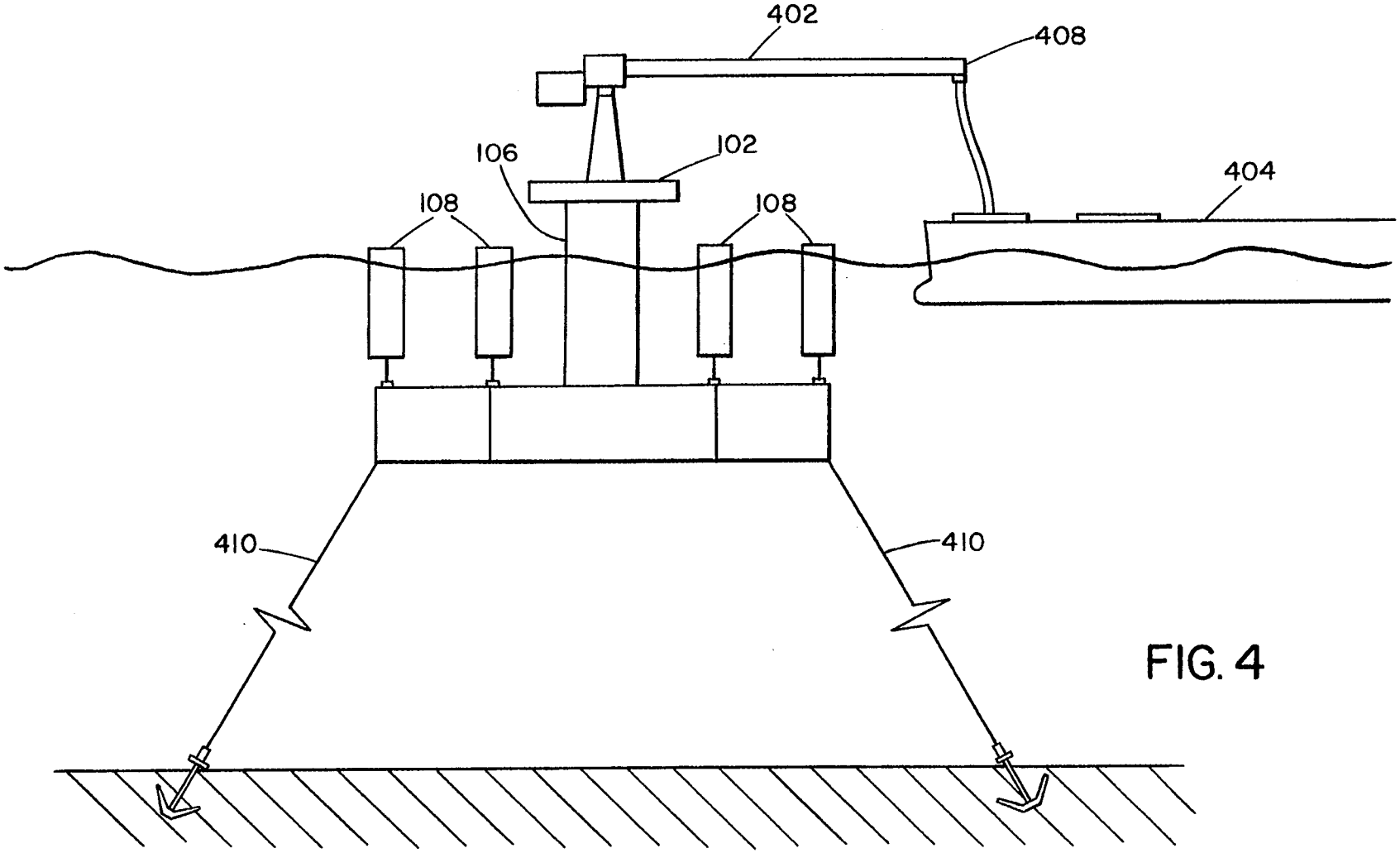
FIG. 4 is a side-view of the semi-submersible offshore platform of the present invention.

With reference to FIG. 4, the deck 102 is coupled to the support column 106. The deck 102 may include a boom 402 for off-loading oil to a tanker 404; pumps (not shown) for pumping water, air and oil; mooring machinery (not shown); handling equipment (not shown), prime movers (not shown); and other equipment. Preferably, the boom 402 is rotatable 360 degrees, such that the boom 402 can be positioned above the tanker 404 to facilitate off-loading. Due to the stability produced by the buoys 108, the end 408 of the boom 402 will experience little sway or heave movement even in rough seas. As a result, off-loading of oil from the platform 100 to the tanker 404 can be conducted even in the worst conditions, minimizing the need to discontinue off-loading when such conditions occur.

Figure 5:
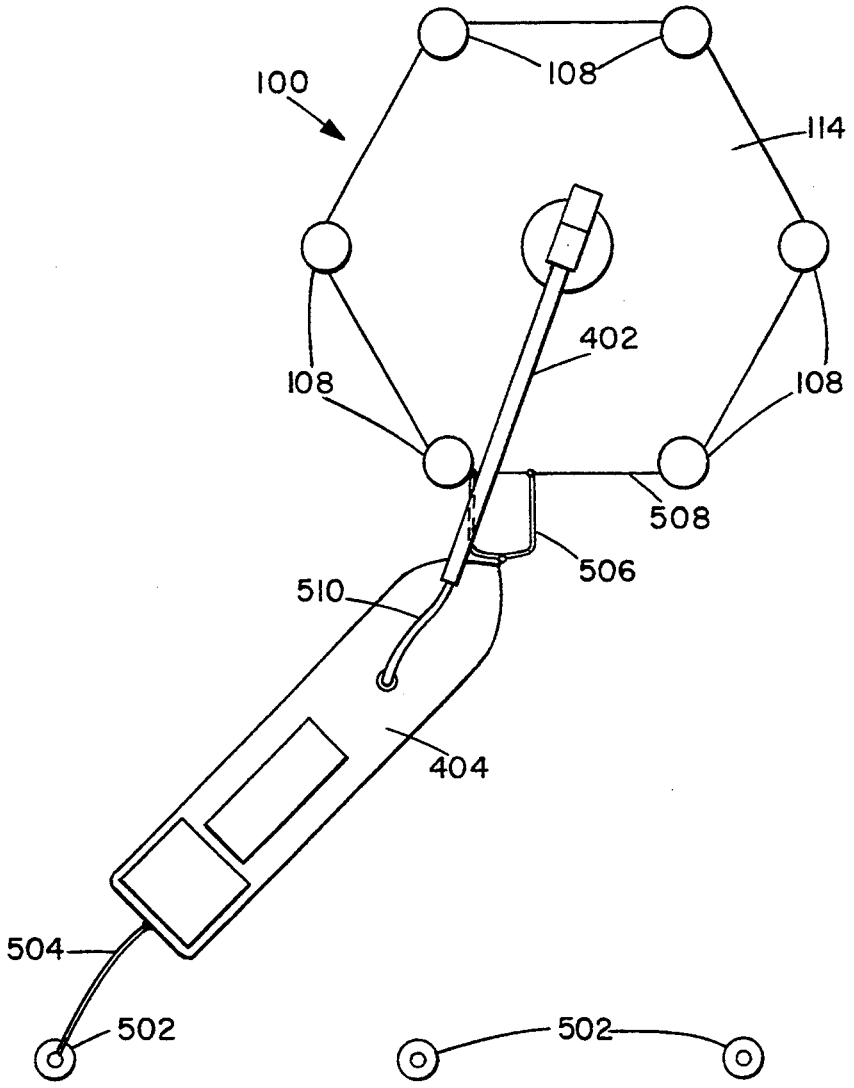
FIG. 5 is a top-view of the semi-submersible offshore platform of the present invention, illustrating off-loading of oil stored in the hull to a tanker.

The platform 100 is affixed to the sea floor by mooring lines 410. Preferably, six to twelve mooring lines 410 are used, but any number is acceptable. Referring now to FIG. 5, when the tanker 404 approaches the platform 100, the tanker 404 comes in up-wind and picks up a stern line 504 from a stern mooring buoy 502, and a hawser or bridle 506 is then picked up from the bow 508 of the platform and affixed to the tanker 404, such that the tanker is restrained both fore and aft, between the platform 100 and the stern mooring buoy 502. Preferably, three stern mooring buoys 502 are employed. Product hoses 510 are delivered to the tanker 404 via the overhead boom 402, and pumping continues until a full load is taken aboard the tanker 404. If sea direction should change markedly during the loading process, the stern mooring can be shifted to another stern mooring buoy 502 without interrupting the loading process.

When departing the platform 100, the tanker 404 drops the stern mooring and product hoses 510, backs down to clear the area, and then drops the bow mooring hawser 506. Due to the 100 to 150 foot length of the support column 106, the top 114 of the hull 104 will be submerged to approximately 100 feet beneath the surface of the water. Consequently, it is virtually impossible for a tanker to make contact with the hull 104. Thus, the oil storage in the hull 104 is sufficiently deep, precluding any danger of storage tank 202 rupture and oil spillage from collision damage.

A model of the platform 100 was tested to study the effects of various wave action on stability of the platform. The tested platform was similar to the preferred embodiment illustrated in FIG. 1 and had buoys 108 that pitch and roll relative to the platform 100 and each other, but that did not heave. The tested platform was moored with single bow and stern lines. The mooring lines were non-linear springs to simulate the catenary associated with deep water moorings. A load cell in each line permitted the measurement of line pre-tension as well as peak to peak loads in each line. In the interest of simplifying the study, the two mooring lines were used instead of a full spread mooring system of between six and twelve mooring lines. This is considered a permissible course of action, because the platform is essentially omnidirectional in terms of its response to the sea and waves.

In 20 foot random sea (i.e., 20 foot random waves), there existed a noticeable absence of any tendency for the model to surge in the mooring. This was confirmed by the mooring line load cell readings, which were very steady throughout the entire test. The maximum increase in bow line tension was 40,500 pounds. In 60 foot random sea, considerably more action existed in the surge response of the platform, but again there was an absence of any sharp and violent surges that result in sharp peaks in the mooring line loads. Model test results in regular seas for a model of the platform illustrated in FIG. 1 are shown in FIG. 6.

Figure 7:
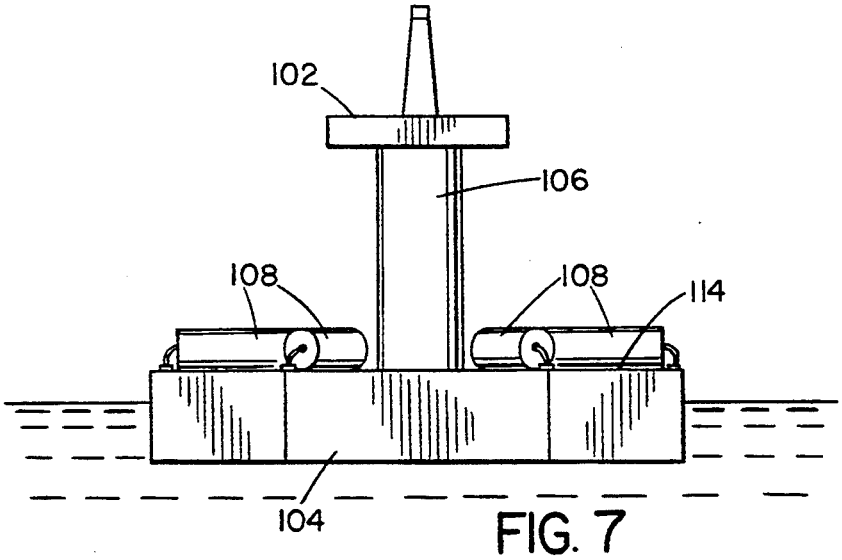
FIG. 7 is a side-view of the offshore platform of the present invention illustrating deployment of the platform.

Deployment of the platform 100 will now be described with reference to FIG. 7. As illustrated in FIG. 7, preferably, the platform 100 is towed to the drilling-/exploration site on the surface of the water. Alternatively, the platform 100 may be self-propelled. The transit draft of the hull is approximately 30 feet. In transit, the articulate columnar buoys 108 are secured in a horizontal position on the main deck or top 114 of the hull 104. Upon arrival at the designated site, the platform 100 is moored in a six or twelve point moor, as described above. The buoys 108 are then freed from the main deck 602 and thus rendered operable, and the tanks 202, 204 are flooded to submerge the hull 104 to its prescribed draft. The buoys 108 provide stability during the submerging evolution.

After being submerged to the prescribed draft, the platform 100 is ready to commence its prescribed function. The articulated buoys 108 are free to rotate about their base, thus minimizing stresses and motions transmitted to the hull 104. The buoys 108 also provide a righting moment to the hull 104 while minimizing heave response. Due to the large mass of the submerged portion, the natural heave and pitch periods are very long and cannot be exited at its natural period by the sea.

The system for stabilizing the platform of the present invention will now be described with reference to FIGS. 8 through 15. Various embodiments of the system are illustrated in those Figures.

Figure 9:
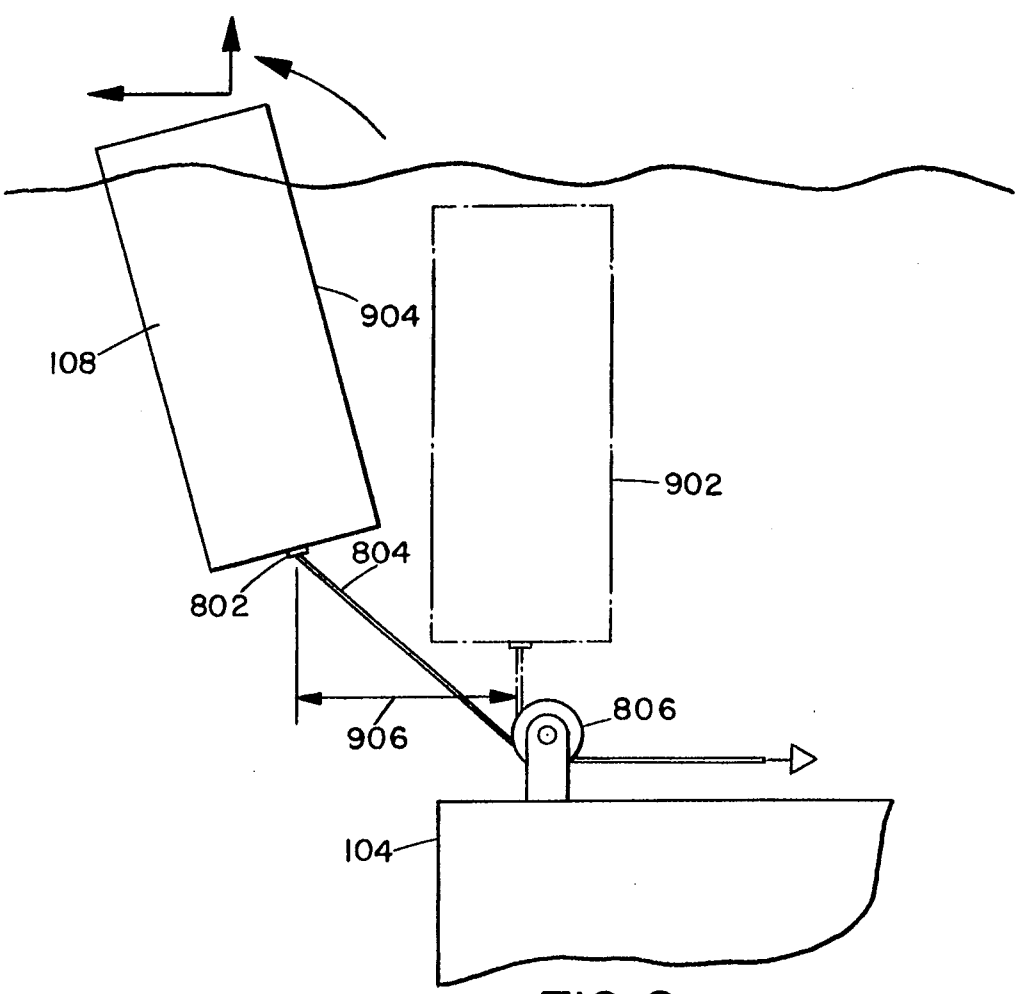
FIG. 9 illustrates the buoy of FIG. 8, showing that the buoy can also sway and/or surge relative to the hull.
Figure 8:
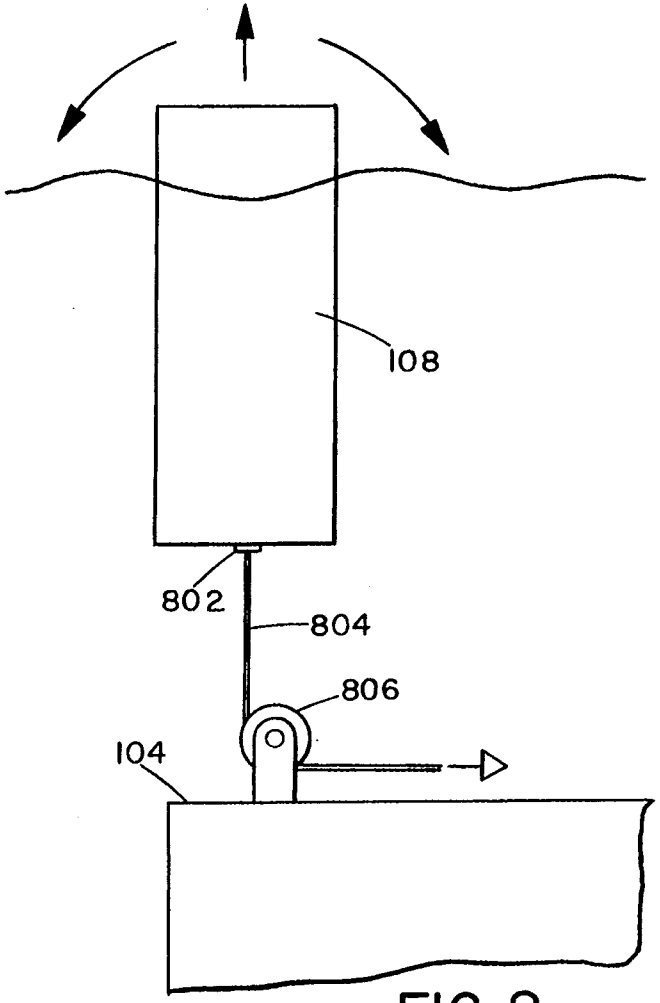
FIG. 8 illustrates a buoy coupled to a hull, the buoy being capable of heaving, pitching, and rolling relative to the hull.

Referring to the embodiment shown in FIGS. 8–9, the buoy 108 can pitch and roll and can heave, sway, and surge. The buoy 108 is connected at a point 802 on the underside of the buoy to a line or chain 804. The line 804 runs through a guide or pulley device 806 to a constant tension device or torsion spool (not shown). The pulley is affixed to the hull 104. The constant tension device or torsion spool is well-known, an example of which is disclosed in U.S. Pat. No. 4,065,101. Such a device maintains a constant tension on the line or chain 804. Still, the tension level can be adjusted on the device, either manually, mechanically, or electrically. Accordingly, the device is adjustable and can maintain many various levels of constant tension. Once the tension level is set, even in variable seas, the buoy 108 will be maintained at a constant tension. Wave action will generate vertical forces, i.e., forces along the axis 810 of the buoy 108, and the buoy, affixed to the constant tension device, will move up and down (i.e., heave) relative to the hull 104 in response to the vertical wave forces.

Referring now to FIG. 9, both the heave, sway, and surge motions of the buoy 108 are illustrated. In response to wave action, the buoy moves from its' original stationary location 902 to another position 904. As illustrated, the heave and sway motions are permitted by the constant tension device paying out the line 804, while maintaining constant tension. The amount of sway (or sway distance) 906 is shown as the linear distance the buoy 108 travels parallel to the surface of the water. Those skilled in the art will recognize that, in the orthogonal plane to that illustrated, the buoy also can surge relative to the hull. The buoy 108 also pitches and rolls (i.e., moves radially), as does a buoy that is statically fixed to the hull 104. Of course, depending on the frequency and magnitude of the forces generated by the wave action, the tension level on the constant tension device can be adjusted to regulate the amount of line 804 that the constant tension device will pay out, thereby increasing stability of the platform by monitoring and adjusting movement of the various buoys 108. As noted above, because the buoys illustrated herein are preferably cylindrical in shape, the ability to yaw is not significant. If, however, the buoys had a shape, such as rectangular, for which yaw would be significant, a swivel joint could be added that would permit the buoy to yaw.

In the preferred embodiment having the hexagonal hull 104 with six buoys 108 attached at each corner 110, all six buoys are preferably attached to a constant tension device. The tension level of each device can be adjusted to compensate for various wave action to control motion of the buoys. Adjustments can be made individually for each buoy. Because all buoys need not be identically shaped and buoyant, the tension levels for each constant tension device need not be identical. Preferably, however, the buoys are identical, and the tension levels will be maintained the same for each buoy.

Figure 10:
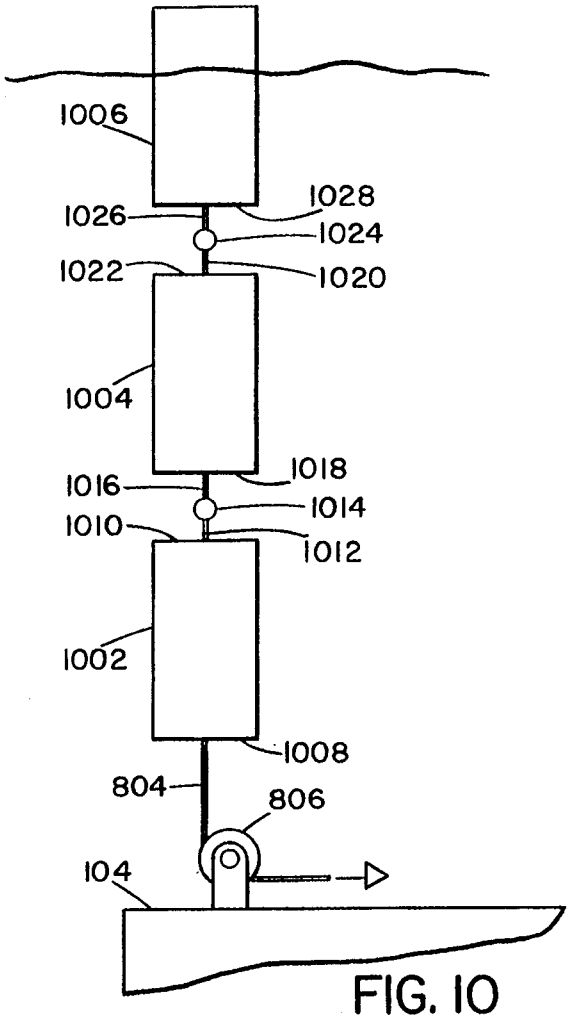
FIG. 10 illustrates a series of three buoys coupled to a hull, the buoys being capable of heaving, pitching, rolling, swaying, and surging relative to the hull.

FIG. 10 illustrates a series of articulated buoys, in which the buoys can pitch and roll relative to each other. It will be understood, as with the system of articulated buoys described with respect to FIGS. 8–9, that several series of buoys will be coupled to the hull 104. In the system of FIG. 10, a constant tension device (not shown) is again used to permit heave, sway, as well as pitch and roll, for the series of three buoys 1002, 1004, 1006. Although three buoys are illustrated strung together in FIG. 10, as those skilled in the art will recognize, any number of buoys can be used, depending on buoy size, number of buoy strings, and numerous other factors. The constant tension device is attached to the line or chain 804, which is fed through a guide or pulley device 806 affixed to the hull 104. The line 804 is then attached to the underside 1008 of the first buoy 1002. The topside 1010 of the first buoy 1002 is then connected to a second line or chain 1012, which is in turn connected to a universal joint 1014. The universal joint 1014 is connected to a third line or chain 1016, which is in turn connected to the underside 1018 of the second buoy 1004. The second buoy 1004 is connected to the third buoy 1006 in the same way as the first and second buoys 1002, 1004, respectively. Accordingly, the connection between the second buoy 1004 and the third buoy 1006 includes a fourth line or chain 1020 connected to the topside 1022 of the second buoy and to a second universal joint 1024 and a fifth line or chain 1026 connected to the second universal joint 1024 and to the underside 1028 of the third buoy 1006.

In this configuration, the series of buoys can pitch and roll and can heave, sway and surge, like the embodiment disclosed in FIGS. 8–9, and each buoy in the series can pitch and roll relative to each other. Accordingly, another degree of movement is added to the articulated buoys, resulting in even greater stability of the platform 100 in rough seas. Of course, variations on or modifications of the illustrated buoy series can be made, including changing the number of buoys in the series, changing their size and/or shape, and omitting the constant tension device and guide 806, affixing the series of buoys instead directly to a universal joint mounted on the hull 104. Also, it should be understood that universal joints can be employed between any points connecting a buoy to facilitate its freedom of movement in response to wave action.

Figures 11A, 11B, 11C, 11D:
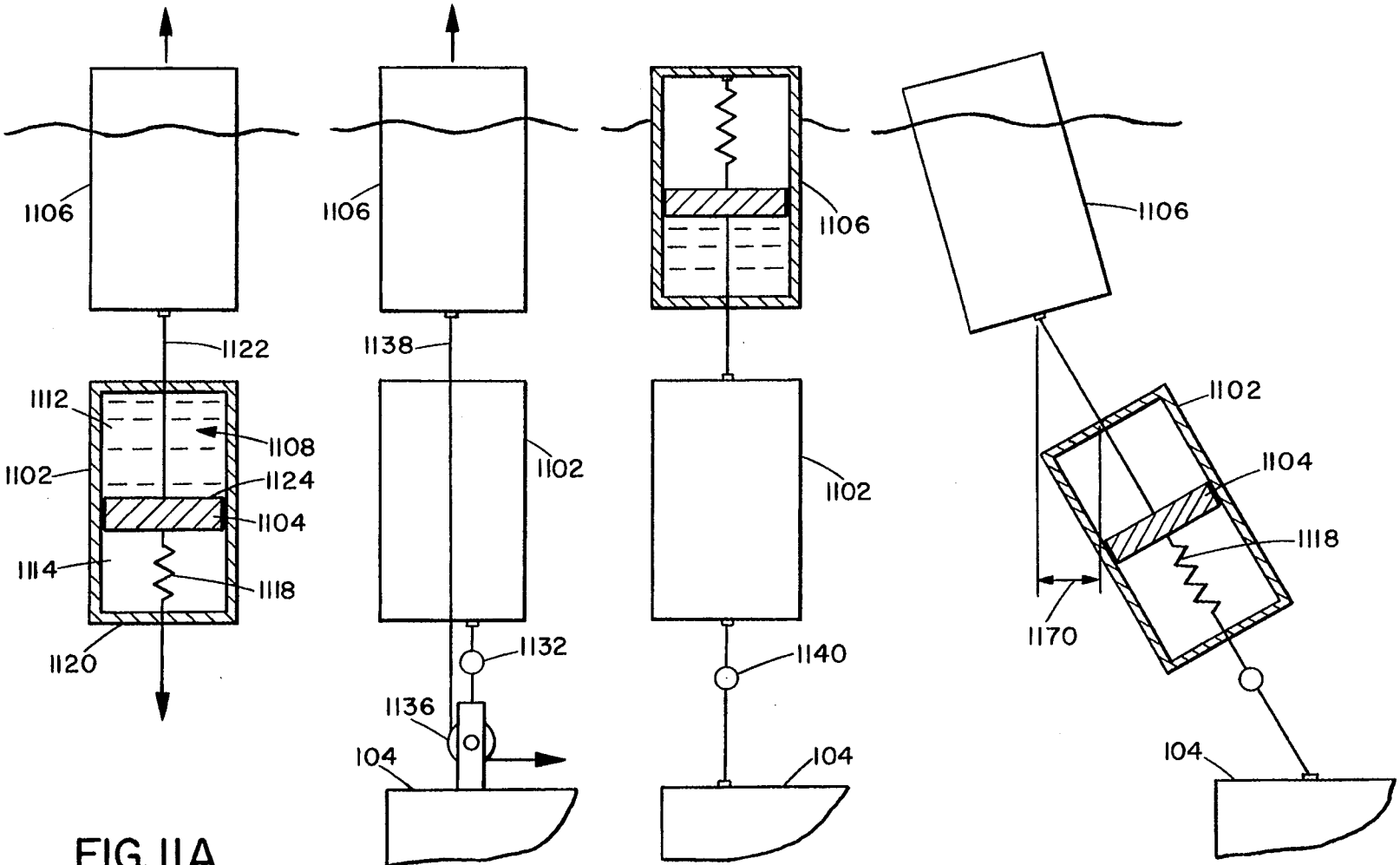
FIGS. 11A–11F illustrate various embodiments of series of buoys having additional features that permit one of the buoys in the series to heave, sway, and surge relative to the other buoy in the series.

FIGS. 11A–11C illustrate another embodiment of the present invention of articulated buoys that can heave relative to each other. The embodiment illustrated in FIG. 11A includes at least two buoys strung together, the bottom buoy 1102 having an internal piston 1104 permitting the top buoy 1106 to heave, sway, and surge relative to the bottom buoy 1102. There are many different piston-type devices or hydraulic and/or pneumatic dampers that will work well in the present invention. For example, as illustrated, the elongated bottom buoy 1102 will have a hollow elongated cavity 1108 in or near the vertical axis of the bottom buoy 1102, in which cavity 1108 the piston 1104 travels along the vertical axis of the bottom buoy 1102. For the sake of simplicity, a piston arrangement is illustrated and will be described herein.

The piston 1104 splits the interior cavity 1108 into a top chamber 1112 and a bottom chamber 1114. The top chamber 1112 holds a fluid. The bottom chamber 1114 has little or no fluid, but includes a spring 1118 connected to the piston 1104 for forcing the piston back toward the underside 1120 of the bottom buoy 1102 in response to upward heave motion on the top buoy 1106. Instead of the spring 1118, a constant tension device (not shown) could be used to force the piston 1104 back toward the underside 1120. A line or chain 1122 then attaches to the top side 1124 of the piston 1104 and runs through the cavity 1108, out through the top of the bottom buoy 1102 and attaches to the underside of the top buoy 1106. In this way, the top buoy 1106 can heave relative to the bottom buoy 1102. The buoys 1102, 1106 can be connected to the hull 104 by a universal joint or a constant tension device. If the former, the buoys will pitch and roll, and the top buoy 1106 will heave relative to the bottom buoy 1102, but the bottom buoy will not heave, and the buoys will not sway or surge. If a constant tension device is used, however, the buoys will heave, sway, and surge and will pitch and roll as a unit, as described above, and the top buoy 1106 will additionally heave, sway, and surge relative to the bottom buoy 1102.

The embodiment illustrated in FIG. 11B also provides a system by which the top buoy 1106 heaves, sways, and surges relative to the bottom buoy 1102. In this embodiment, however, no piston is used; instead, a constant tension device (not shown) and a universal joint 1132 are used to obtain such heaving, swaying, and surging motion. The bottom buoy 1102 is affixed to the hull 104 by the universal joint 1132 that is attached to a guide or pulley device 1136; the bottom buoy thus does not heave or sway. The top buoy 1106, on the other hand, is connected to the hull 104 through the guide or pulley device 1136 and the constant tension device. The line or chain 1138 connecting the top buoy 1106 to the constant tension device runs through the vertical axis of the bottom buoy 1102. Accordingly, while the bottom buoy does not heave or sway, the top buoy heaves relative to the bottom buoy and may additionally sway and surge longitudinally from the top of the bottom buoy.

FIG. 11C illustrates another system of buoys permitting the top buoy 1106 to heave, sway, and surge relative to the bottom buoy 1102. This version is similar to the one illustrated in FIG. 11A, except here the piston system is located in the top buoy 1106. This version, therefore, works in an opposite manner from the one shown in FIG. 11A, but achieves the same result. As shown in FIG. 11C, the bottom and top buoys 1102, 1106 can be coupled to the hull 104 by a universal joint 1140. Alternatively, the buoys can be coupled to the hull 104 by a constant tension device (not shown), permitting heave, sway, and surge of both buoys relative to the hull 104 and to the other buoy series coupled to the hull.

Referring now to FIG. 11D, the ability of the buoys of the embodiment illustrated in FIG. 11A to sway and surge relative to each other is shown. Due to the piston arrangement 1104 and the constant tension device 1118 (such as a spring or winch), in response to wave action, the top buoy 1106 sways and/or surges some distance 1170 from the bottom buoy 1102. While FIG. 11D illustrates the embodiment of FIG. 11A, this same motion phenomenon will occur in the embodiments illustrated in FIGS. 11B and 11C.

The piston arrangement or hydraulic and/or pneumatic damper is an optional part of all the individual buoys, no matter the embodiment. Thus, for example, in the embodiment illustrated in FIG. 10 having two or more buoys (three being shown), all or several or one can be equipped with a piston or damper device to permit the individual buoys in the series to heave, sway, and surge relative to each other. Single buoys, like the one illustrated in FIGS. 8–9, can also be equipped with a spring or damper device to facilitate heave motion relative to the hull. Moreover, the piston or damper device can be supplied in either of the configurations illustrated in FIGS. 11A and 11C.

Figure 11F:
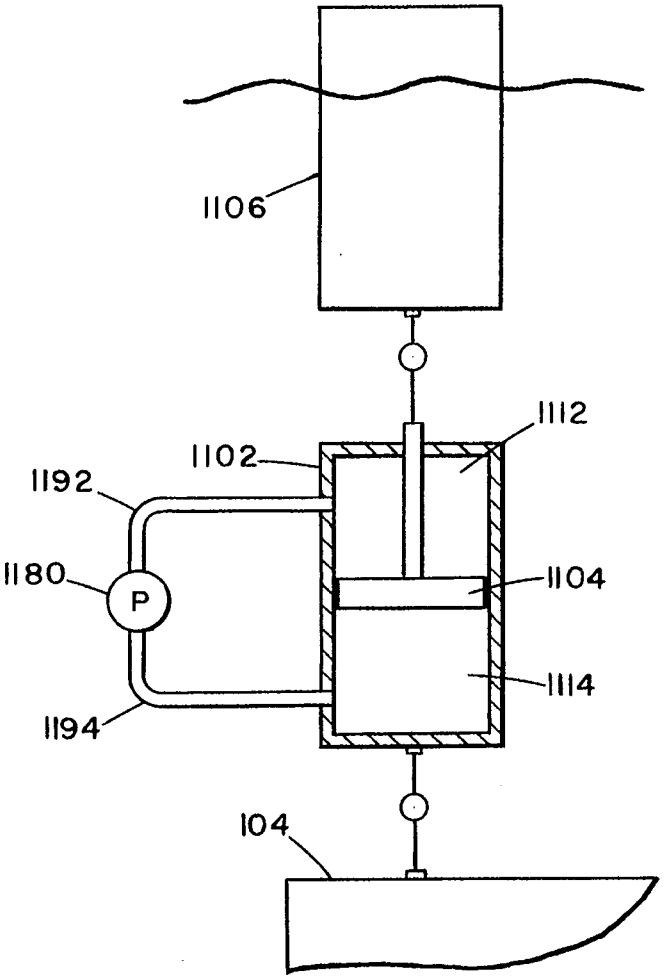
Figure 11E:
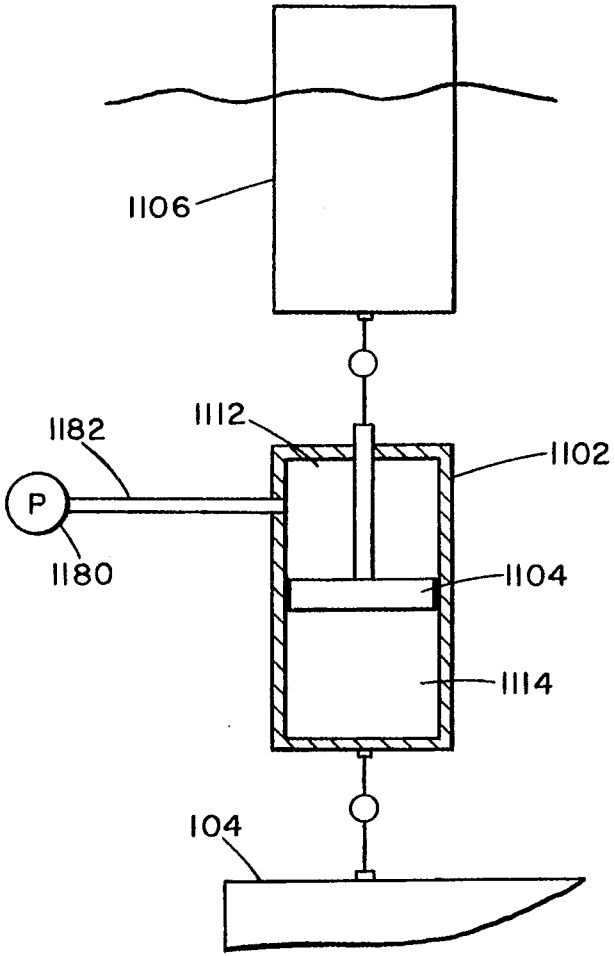

FIG. 11E illustrates another embodiment in which the top buoy 1106 can heave (as well as sway and surge) relative to the bottom buoy 1102 by volumetrically compensating the piston. Here, the bottom buoy 1102 is equipped with a pump 1180 to control upward and downward motion of the piston 1104 within the bottom buoy 1102. The pump 1180, which can be located in the hull 104, in the column 106, or on the deck 102, is connected to the buoy 1202 via a hose 1182. In response to wave action, the pump 1180 can volumetrically compensate the top chamber 1112 (or alternatively the bottom chamber 1114) of the bottom buoy 1102. Accordingly, the pump will remove water (or other fluid) from the top chamber 1112 to permit upward movement of the top buoy 1106, and will add fluid to the top chamber 1112 to force the piston 1104 and thus the top buoy 1106 downward.

Alternatively, as shown in FIG. 11F the pump 1180 can be connected to the bottom buoy 1102 such that it pressure compensates the top and bottom chambers 1112, 1114 of the bottom buoy 1102. In this configuration, the pump 1180 is connected via hoses 1192, 1194 between the top and bottom chambers 1112, 1114 so that the pump 1180 can pump fluid into and out of the top and bottom chambers to move the piston 1104 up and down. Again, here, the pump 1180 can be located virtually anywhere in or on the platform 100, including within or on the buoys.

Figure 12:
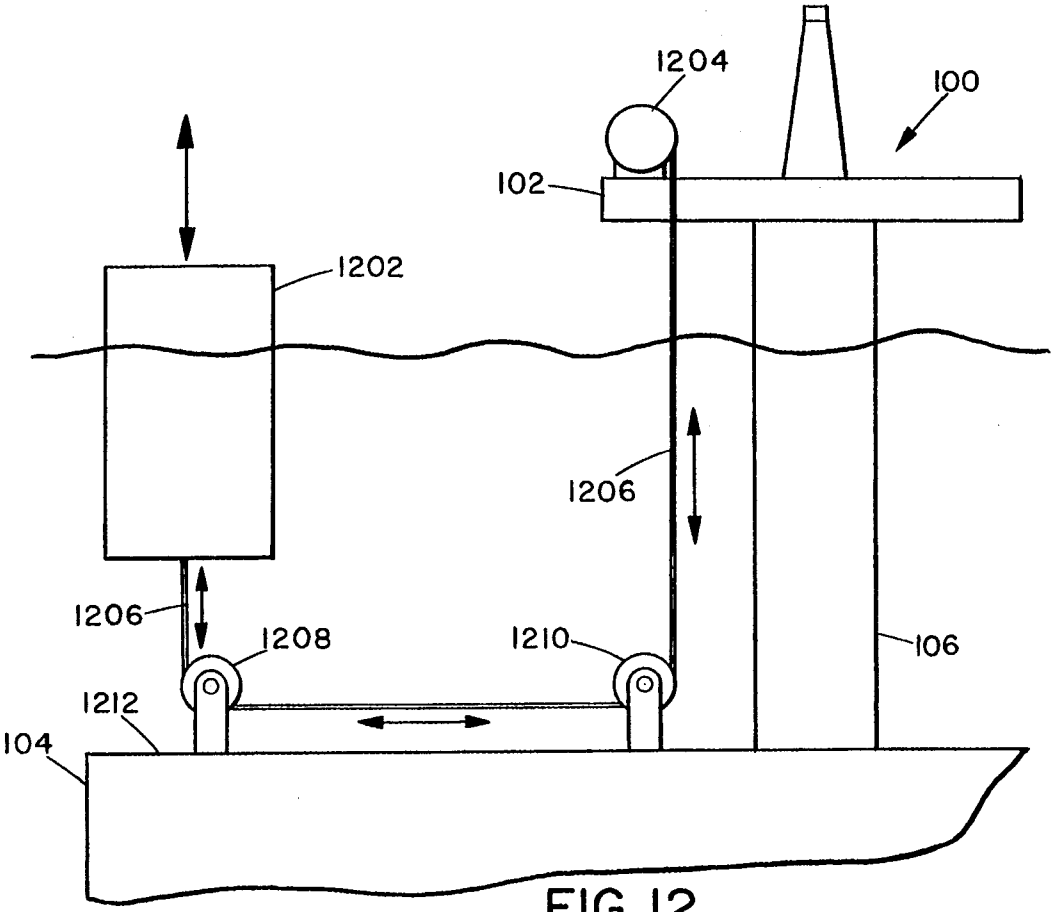
FIG. 12 illustrates a buoy coupled to a constant tension device that permits the buoy to heave, sway, and surge relative to the hull.

FIG. 12 illustrates one way by which articulated buoys 1202 can be coupled to the constant tension device 1204. Here, the constant tension device 1204 is mounted on the deck 102 of the platform 100 and thus remains out of the water. The constant tension device 1204 is coupled to the buoy 1202 via a line or chain 1206 and two guide or pulley devices 1208, 1210. Each of the guide or pulley devices 1208, 1210 are affixed to the top 1212 of the hull 104. In this configuration, the buoy 1202 can heave, sway, and surge relative to the platform and to other buoys and can pitch and roll. As those skilled in the art will recognize, this is but one way the buoys 1202 can be coupled to the constant tension device 1204. For example, the line or chain 1206 can be routed through the hull 104 and the fixed column 106, maintaining the line and the guides 1208, 1210 internally within the platform 100. Alternatively, the constant tension device 1204 can be located within the hull 104 directly beneath the buoy 1202, obviating the need for the external guides 1208, 1210.

Figure 13:
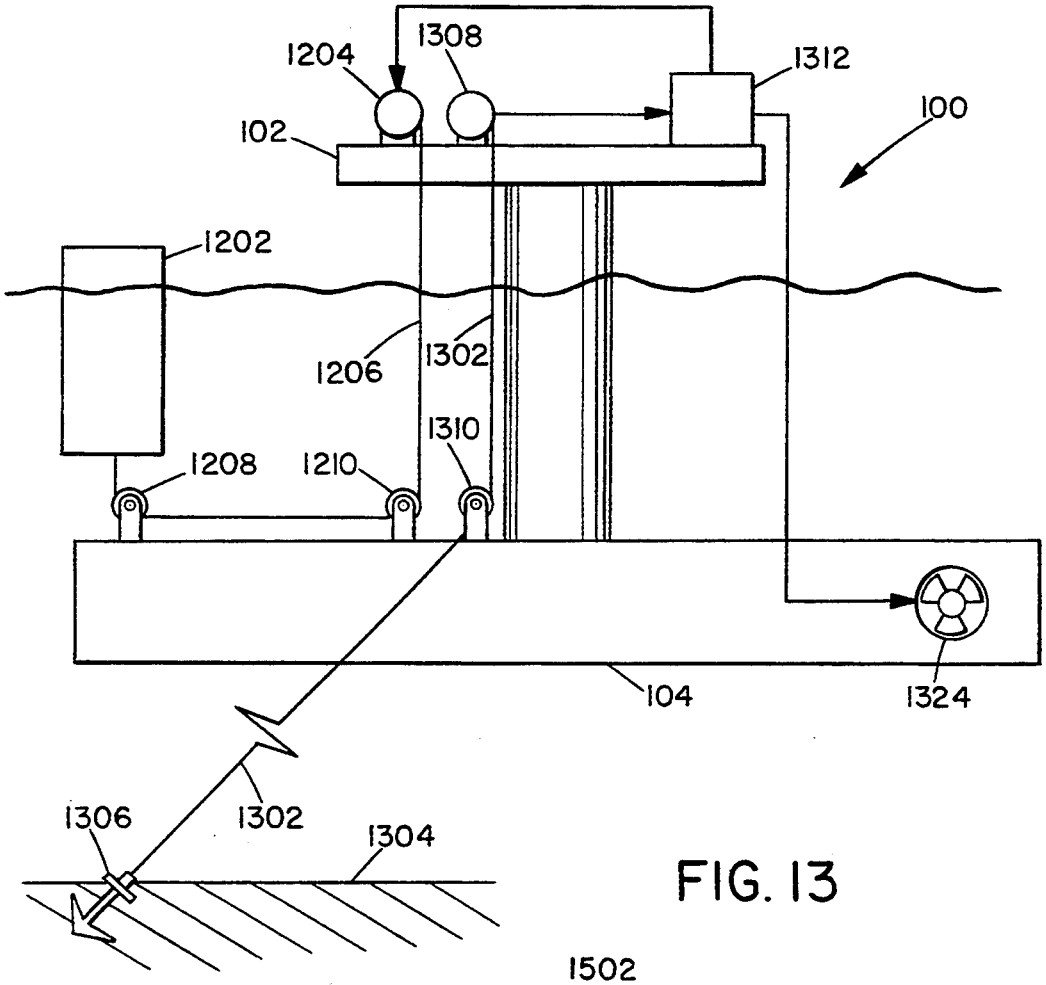
FIG. 13 illustrates a monitoring and control system that controls a tension level in the constant tension device in response to loads on a mooring line.

With reference to FIG. 13, a system is illustrated in which the tension level on the constant tension device 1204 is controlled by feedback signals from a monitoring system. Specifically, the platform 100 will be equipped with at least one mooring line 1302, which is affixed to the ocean floor 1304 by some type of anchoring device 1306. The mooring line 1302 is in turn coupled to the deck 102 of the platform 100 by means of a mooring winch 1308 and, optionally, a pulley or guide device 1310.

A monitoring system 1312 is connected to the mooring line 1302 in order to monitor the forces and loads and/or the frequencies of those forces and loads on the mooring line 1302. The information obtained by the monitoring system 1312 from the mooring line 1302 is then processed to formulate an appropriate tension level to feed-back to the constant tension device 1204 in order to control the tension level of that device. The constant tension device 1204, as described above, will be equipped with a mechanical or electrical adjusting mechanism that can vary the tension level of the device. In turn, the constant tension device 1204 is connected to a line or chain 1206 that is coupled through two pulley or guide devices 1208, 1210 to an elongated buoy 1202. As shown, the buoy 1202 can heave, sway, surge, and move radially (pitch and roll) relative to the hull 104 and relative to the other buoys (not shown) coupled to the hull 104.

The monitoring system 1312 can also feed signals to one or more thrusters 1324. The monitoring system 1312, as it does for the constant tension device 1204, receives feedback signals from the mooring line 1302. The monitoring system 1312 then processes these signals and formulates a thrust level that will reduce mooring line loads caused by sea conditions, including low frequency oscillations and drift of the entire platform 100. The monitoring system 1312 then sends a feedback signal corresponding to this thrust level to the thruster 1324, which in response accelerates, decelerates, deactivates, or remains constant to reduce mooring line loads.

As those skilled in the art will appreciate, the monitoring system 1312 preferably will transmit the same tension level signal to the constant tension device corresponding to each of the articulated buoys on the platform. Each buoy, then, will be subjected to the required amount of tension and will react similarly to wave conditions. As for the thrusters 1324, as noted above, the platform 100 may have several, with each one directed in a different direction or in a required direction. Accordingly, the monitoring system 1312 will transmit varying thrust level signals to each of the thrusters, depending on which direction needs thrust to reduce mooring line loads. Of course, the thrusters can also be made to operate in reverse to pull against the hull 104, rather than push against it. Preferably, mooring lines 1302 are omitted when thrusters 1324 are employed for dynamically positioning the platform 100 in response to environmental forces, such as wind and wave action.

The monitoring system 1312 is preferably a computer system that can monitor feedback signals from the mooring lines 1302 and process those signals to obtain tension and/or thrust levels. The computer system may use hardware, software, or a combination of the two to effectuate process control.

Figure 14:
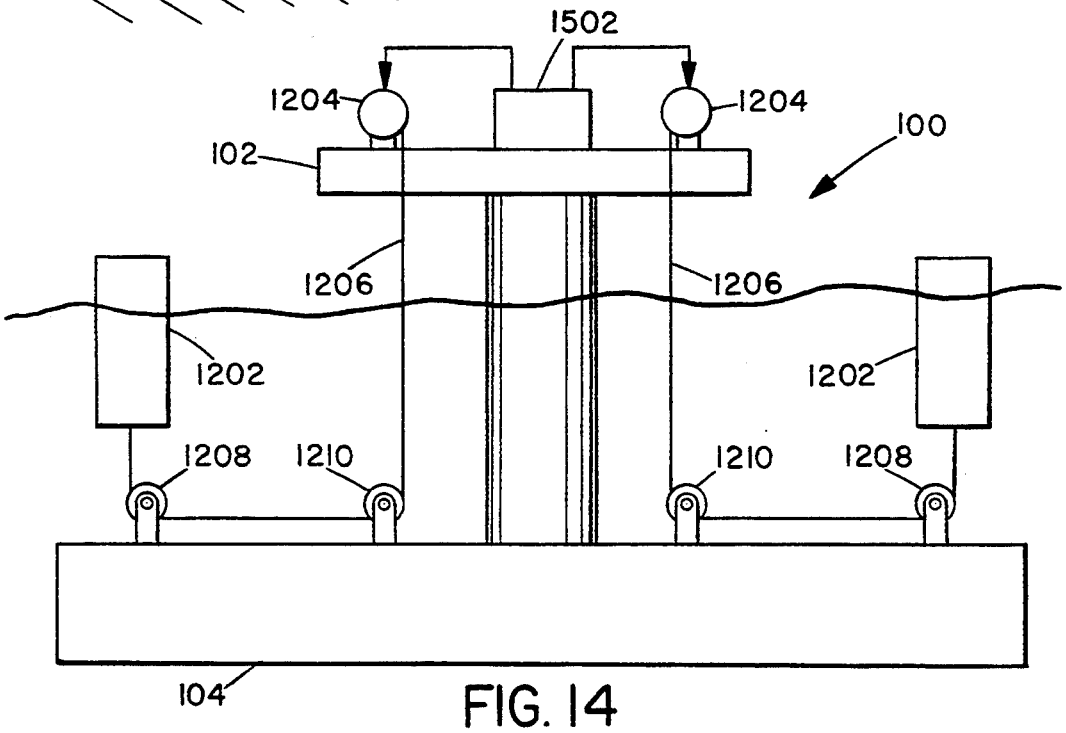
FIG. 14 illustrates a monitoring and control system that controls the tension level in constant tension devices in response to motion of the platform.

As an alternative, with reference to FIG. 14, a control system can be provided that monitors the motion of the platform 100, as opposed to the mooring line(s) 1302. As shown, a motion sensing device and processor 1402 can be placed on the deck 102 and connected to the constant tension devices 1204. In response to motion of the platform, the control system will process the data from the sensor and processor 1402 and formulate a tension level for the constant tension devices 1204. In this way, excursion of the buoys will be controlled, thereby reducing the motion of the platform 100.

Figure 15:
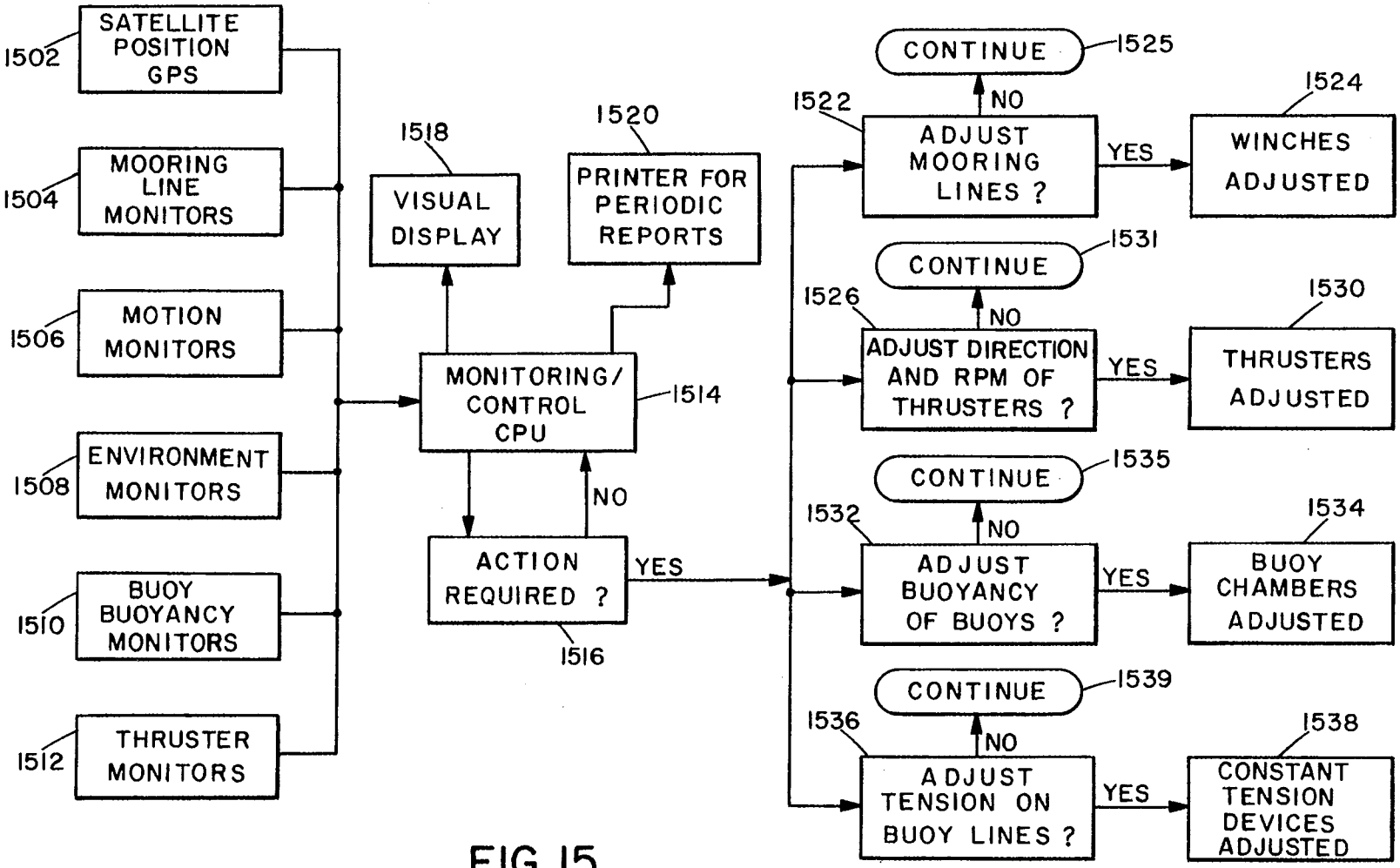
FIG. 15 is a flow diagram illustrating the computer monitoring and control system of the present invention.

Referring now to FIGS. 13, 14, and 15, the monitoring and control system used to regulate motion of the buoys of the present invention will be described in connection with the flow chart of FIG. 15. A variety of inputs (reference numerals 1502, 1504, 1506, 1508, 1510, 1512)can be used to provide the monitoring (or sensing) of wave and wind action to which the buoys 1202, mooring lines 1302, thrusters 1324, and constant tension devices 1204 can be adjusted in order to minimize such wave and wind action on the platform 100.

For example, a global positioning system ("GPS") input 1502 from a satellite can be used to monitor the position of the platform 100 in the ocean. Thus, as the platform 100 moves, the GPS input 1502 will sense this and feed an input signal to the Monitoring/Control CPU 1514, which will then process the signal and either trigger an action or inaction in response to the signal (step 1516). GPS devices for monitoring the position of a body are well known in the art. Similarly, motion monitors 1506 can be used to provide the Monitoring-/Control CPU 1514 with input signals measuring the motion of the buoys 1202 in the water. As is also well known in the art, motion monitors can be employed that detect and measure the six degrees of motion of the buoys, i.e., surge, sway, heave, pitch, roll, and yaw. The motion monitor 1506 will determine if any one or all of these motions exceeds some predetermined acceptable limit, and when such occurs, the Monitoring/Control CPU 1514 will react by signalling that action is required (step 1516).

Other monitoring devices include a monitor 1504 for the mooring lines 1302, environment monitors 1508, buoyancy monitors 1510 for the buoys 1202, and/or monitors 1512 for the thrusters 1324. As those skilled in the art will appreciate, any one or several of these input signals can be input to the monitoring control CPU 1514. The more that are used, the more precise control of the buoys will be.

As is well known in the art, the mooring monitor 1504 for the mooring lines 1302 may comprise a load cell, which monitors the tension in the mooring lines 1302. The environment monitors 1508 measure the height of the waves and their direction, as well as the direction and velocity (and even gustiness) of the wind. Such environment monitors are also well known in the art. The buoyancy monitors 1510 are directed to the buoys 1202, detecting and measuring, for example, the tension in the constant tension device 1204. The buoyancy monitors 1510 can also measure the depth of the buoys 1202, for it is undesirable to have the buoys 1202 submerged. The buoyancy monitors 1510 can also be used to assess fatigue on the buoys 1202 or buoy lines 1206, to monitor the stress on the universal joints (if any) connecting the buoys to the hull 104 and to each other, and to monitor the stress on the constant tension devices 1204. A motion detecting package can also be supplied for the buoys 1202 that monitors the six-degrees of motion of the buoys. Finally, as is also well known, the thruster monitors 1512 can monitor whether the thrusters 1324 are on or off, the direction in which they are pointed, and the amount of thrust they are generating.

The Monitoring/Control CPU 1514 can be equipped with a visual display 1518 and a printer 1520 to produce periodic status reports of the system. The Monitoring-/Control CPU 1514, in response to the input signals, will determine whether action is required (step 1516) to compensate for wind and/or wave action. If no action is required in step 1516 (i.e., the "NO" branch), the Monitoring/Control CPU 1514 will continue monitoring the input signals and will continue asking whether action is required (step 1516). When the Monitoring-/Control CPU 1514 determines that action is required (the "YES" branch of step 1516), it will supply an output signal to one of a variety of devices that compensate for wind and wave action. The Monitoring/Control CPU can feed an output signal to any one or a combination of devices that compensate for forces acting on the platform.

Examples of such compensating or adjusting devices include winches 1524 that adjust the mooring lines 1302, thruster controls 1530 that control direction and RPM of the thrusters 1324, buoyancy chambers 1534 that adjust buoyancy of the buoys 1202, and constant tension controls 1538 that control tension on the constant tension devices 1204 and hence the buoy lines 1206. Because several such types of devices can be employed, when it is determined that action is required (step 1516), additional decisions must be made as to which devices will take action and to what extent.

Thus, the system inquires whether each or all of the compensating devices need be adjusted. For example, the system determines whether mooring need be adjusted (step 1522), and, if so, the winches 1524 that control the mooring lines 1302 are adjusted according to wind and wave action. If the mooring lines 1302 need not be adjusted, then no action is taken (step 1525). Similarly, it must be decided whether the thrusters 1324 need adjustment (step 1526). If so, it must also be determined in which direction and at what speed (RPM) the thrusters 1324 must be adjusted (step 1530). If no adjustment of the thrusters is required, as determined by step 1526, then no action is taken (step 1531 ). Also, it must be determined whether buoyancy of the buoys 1202 need be adjusted (step 1532), and, if so, how much the buoyancy need be changed. If it is determined that buoyancy must be adjusted, the tanks 1534 are compensated and buoyancy is altered. If, on the other hand, no buoyancy adjustment is necessary, no action is taken (step 1535). Finally, it must be determined whether the buoy lines 1206 need adjustment (step 1536). If so, the constant tension devices 1204 are accordingly adjusted (step 1538), and, if not, no action is taken (step 1539).

It should be understood that only one of the inputs to the monitoring control CPU 1514 is required for the present system, although it is preferable to have multiple inputs in order to most accurately control the platform with respect to wave and wind action. Similarly, only one of the output devices need be employed, but it is preferable to employ several or all of them. The number of inputs and outputs that are used is dependent upon the desired complexity of the system and the amount of adjustment to the platform in response to wind and wave action that the platform 100 will require based on the severity of the conditions it will likely experience.

It will be apparent to those skilled in the art that various modifications and variations can be made in the apparatus and method of the present invention without departing form the spirit or scope of the invention. Thus, it is intended that the present invention cover the modifications and variations of this invention, provided they come within the scope of the appended claims and their equivalents.

What is claimed is:

1. A semi-submersible offshore platform for use in a liquid, comprising:

a floating hull;

a deck coupled to said floating hull; and a plurality of floating stabilizer buoys, at least one of said plurality of floating stabilizer buoys having a coupler for dynamically coupling the stabilizer buoy to said floating hull, whereby said plurality of floating stabilizer buoys can heave, pitch, and roll relative to said floating hull and can heave, pitch, and roll relative to each other, at least one of said plurality of floating stabilizer buoys extending at least partially above the surface of said liquid when said semi-submersible offshore platform is deployed.

2. The semi-submersible offshore platform recited in claim 1 wherein the hull is a hexagonally shaped hull.

3. The semi-submersible offshore platform recited in claim 2 wherein the hexagonally shaped hull has six corners; and wherein one of the plurality of stabilizer buoys is coupled adjacent to each one of said six corners.

4. The semi-submersible offshore platform recited in claim 1 wherein each of the plurality of floating stabilizer buoys has a substantially cylindrical shape.

5. The semi-submersible offshore platform recited in claim 1 wherein each of the plurality of floating stabilizer buoys has a substantially conical shape.

6. The semi-submersible offshore platform recited in claim 1 wherein the coupler comprises a constant tension device.

7. The semi-submersible offshore platform recited in claim 1 wherein the coupler comprises a spring device.

8. The semi-submersible offshore platform recited in claim 7 wherein the spring device is located within at least one of the plurality of stabilizer buoys.

9. The semi-submersible offshore platform recited in claim 7 wherein the spring device is located on the deck.

10. The semi-submersible offshore platform recited in claim 1 wherein the hull has a peripheral edge, the plurality of stabilizer buoys being positioned adjacent said peripheral edge.

11. The semi-submersible offshore platform recited in claim 1 wherein the hull is coupled to the deck via a support member fixed to the hull.

12. The semi-submersible offshore platform recited in claim 1 wherein the hull is coupled to the deck via at least one truss column.

13. The semi-submersible offshore platform recited in claim 1 wherein the hull has at least one oil storage tank.

14. A semi-submersible offshore platform, comprising:

a hull having at least one oil storage tank and a fixed support member, said hull having a peripheral edge;

a deck coupled to said fixed support member; and a plurality of stabilizer buoys, each of said plurality of stabilizer buoys having a coupler for coupling the stabilizer buoy to said hull, said plurality of stabilizer buoys being positioned adjacent said peripheral edge of said hull;

wherein the coupler includes a constant tension device, whereby the plurality of stabilizer buoys can pitch, roll, heave, sway, and surge relative to the hull and can pitch, roll, and heave relative to each other.

15. A semi-submersible offshore platform, comprising:

a hull having at least one oil storage tank and a fixed support member, said hull having a peripheral edge;

a deck coupled to said fixed support member;

a plurality of stabilizer buoys, each of said plurality of stabilizer buoys having a coupler for coupling the stabilizer buoy to said hull, said plurality of stabilizer buoys being positioned adjacent said peripheral edge of said hull, whereby said plurality of stabilizer buoys can pitch, roll, and heave relative to said hull and can pitch, roll, and heave relative to each other, wherein each of the plurality of stabilizer buoys comprises an elongated water-tight vessel having at least one compartment; and a system for ballasting and deballasting said at least one compartment.

16. A semi-submersible offshore platform, comprising:

a hull having at least one oil storage tank, at least one hard tank, and a fixed support member, said hull having a peripheral edge;

a deck coupled to said fixed support member;

a plurality of stabilizer buoys, each of said plurality of stabilizer buoys having a coupler for coupling the stabilizer buoy to said hull, said plurality of stabilizer buoys being positioned adjacent said peripheral edge of said hull, whereby said plurality of stabilizer buoys can pitch, roll, and heave relative to said hull and can pitch, roll, and heave relative to each other; and a system for ballasting and deballasting said at least one hard tank and said at least one oil storage tank, wherein the system compensates the at least one oil storage tank and uncompensates the at least one hard tank in a volumetric ratio of 9 to 2, respectively.

17. A system for stabilizing a semi-submersible offshore platform, said platform having a submersible hull, said system comprising:

a buoyant stabilizer; and a constant tension device attached to said platform and coupled to said buoyant stabilizer, whereby said buoyant stabilizer can pitch, roll, heave, sway, and surge relative to said submersible hull.

18. The system recited in claim 17 wherein the buoyant stabilizer comprises a series of at least two buoys, each buoy in said series having a common axis.

19. The system recited in claim 18 wherein a lower buoy in the series is coupled to an upper buoy in the series via a universal joint.

20. The system recited in claim 19 wherein the lower buoy has a topside and the upper buoy has an underside; and wherein the universal joint has a top and a bottom, and wherein a first line couples said topside of the lower buoy to said bottom of the universal joint and a second line couples said top of the universal joint to the underside of the upper buoy.

21. The system recited in claim 18 wherein the series of at least two buoys includes a bottom buoy, the system further comprising:

a guide affixed to the hull; and a line for coupling the bottom buoy to the constant tension device via said guide.

22. The system recited in claim 21 wherein the guide is a pulley.

23. The system recited in claim 18 wherein the series of at least two buoys has a heave regulating buoy and at least one standard buoy coupled to said heave regulating buoy, said heave regulating buoy having a heave regulating device for controlling the heave of said at least one standard buoy relative to said heave regulating buoy.

24. The system recited in claim 23 wherein the heave regulating buoy has a cavity and the heave regulating device comprises a piston coupled to a second constant tension device, both said piston and said second constant tension device being disposed within said cavity.

25. The system recited in claim 23 wherein the heave regulating buoy has a cavity and the heave regulating device comprises a piston coupled to a spring, both said piston and said spring being disposed within said cavity.

26. The system recited in claim 23 wherein the heave regulating buoy is a bottom buoy in the series of at least two buoys.

27. The system recited in claim 23 wherein the heave regulating buoy is a top buoy in the series of at least two buoys.

28. The system recited in claim 27 wherein the series of at least two buoys has a bottom buoy, said bottom buoy being affixed to the submersible hull via a universal joint.

29. The system recited in claim 23 wherein the heave regulating buoy has a cavity and the heave regulating device comprises a piston disposed within said cavity, the system further comprising a pump for regulating upward and downward movement of said piston within said cavity.

30. The system recited in claim 29 wherein the pump volumetrically compensates the cavity to move the piston upward and downward.

31. The system recited in claim 29 wherein the pump pressure compensates the cavity to move the piston upward and downward.

32. The system recited in claim 17, further comprising a guide affixed to the hull; and a line for coupling the buoyant stabilizer to the constant tension device via said guide.

33. The system recited in claim 17 wherein the buoyant stabilizer comprises at least one buoy coupled to the constant tension device by a line, the system further comprising a fixed buoy coupled to the hull and having an axis, said line passing through said axis.

34. The system recited in claim 33 wherein the fixed buoy is coupled to the hull via a universal joint, the system further comprising a guide affixed to the hull for guiding the line between the at least one buoy and the constant tension device.

35. The system recited in claim 17 wherein the platform includes a deck coupled to the submersible hull and wherein the constant tension device is affixed to said deck, the system further comprising at least one guide and a line coupling the buoyant stabilizer to the constant tension device via said at least one guide.

36. The system recited in claim 35 wherein the at least one guide is a pulley device attached to the hull.

37. The system recited in claim 17, further comprising:

at least one mooring line attached to the platform; and a monitoring system for monitoring loads on said at least one mooring line and for controlling a tension level on the constant tension device in response to said loads.

38. The system recited in claim 37, further comprising:

at least one thruster coupled to the platform, said at least one thruster being controlled by the monitoring system in response to the loads on the at least one mooring line.

39. The system recited in claim 17, further comprising:

a monitoring system for monitoring motions of the platform and for controlling a tension level on the constant tension device in response to said motions.

40. The system recited in claim 17 wherein the constant tension device comprises a spring device.

41. The system recited in claim 17 wherein the constant tension device comprises a torsion spool.

42. The system recited in claim 41 wherein the torsion spool has an adjustable tension level.

* * * * *